US008844961B2

(12) United States Patent
Hunziker

(10) Patent No.: US 8,844,961 B2
(45) Date of Patent: Sep. 30, 2014

(54) STAND-UP UNIT FOR STAND-UP WHEELCHAIRS AND CHAIRS, PARTICULARLY THERAPY CHAIRS

(71) Applicant: Levo AG Wohlen, Wohlen (CH)

(72) Inventor: Kurt Hunziker, Steffisburg (CH)

(73) Assignee: Levo AG Wohlen, Wohlen (CH)

( * ) Notice: Subject to any disclaimer, the term of this patent is extended or adjusted under 35 U.S.C. 154(b) by 0 days.

(21) Appl. No.: 13/850,003

(22) Filed: Mar. 25, 2013

(65) Prior Publication Data

US 2013/0278032 A1 Oct. 24, 2013

Related U.S. Application Data

(62) Division of application No. 12/669,017, filed on Apr. 27, 2010, now Pat. No. 8,403,352.

(51) Int. Cl.
*A61G 5/14* (2006.01)

(52) U.S. Cl.
CPC ..... *A61G 5/14* (2013.01); *A61G 2203/74* (2013.01)
USPC ..... 280/304.1; 297/316; 297/320

(58) Field of Classification Search
CPC ..... A61G 5/1056; A61G 5/14
USPC ..... 16/367; 297/316, 411, 429, 464, 488; 280/304.1, 242
See application file for complete search history.

(56) References Cited

U.S. PATENT DOCUMENTS 7,600,817 B2 * 10/2009 Kramer et al. ..... 297/362.13
8,403,352 B2 * 3/2013 Hunziker ..... 280/304.1

* cited by examiner

*Primary Examiner* — Joseph M Rocca
*Assistant Examiner* — Jacob Knutson
(74) *Attorney, Agent, or Firm* — Davis, Brown, Koehn, Shors & Roberts, P.C.; Sean D. Solberg

(57) ABSTRACT

The stand-up unit comprises a support a stand-up frame, which is articulated on the support and has a seat carrier carrying a seat, and a backrest carrier carrying a backrest. Furthermore, a first lever parallelogram is provided in order to maintain the backrest upright in any position. The backrest can be displaced by the first lever parallelogram by means of a rod, in order to ensure that no undesirable relative movement occurs between the backrest and the back of the user when getting up or sitting down. A second lever parallelogram controls the movement of the seat when getting up and sitting down to ensure that no relative movement develops between the seat and buttocks of the user. The stand-up unit may be provided with a base to serve as a chair, particularly a therapy chair. The stand-up unit, however, may also serve as a stand-up wheelchair, when connected to an undercarriage. Spring joint elements support the standing up.

20 Claims, 4 Drawing Sheets

STAND-UP UNIT FOR STAND-UP WHEELCHAIRS AND CHAIRS, PARTICULARLY THERAPY CHAIRS

CROSS-REFERENCE TO RELATED APPLICATIONS

This Application is a continuation application of Application Ser. No. 12/669,017 which claims priority to PCT/CH2008/000223 filed on May 15, 2008 and CHI 132/07 filed on Jul. 13, 2007, the entirety of each of which is incorporated by this reference.

BACKGROUND OF THE INVENTION

1. Field of the Invention

The invention relates to a stand-up unit with a support and a stand-up mount which is articulated to the support and has a seat carrier carrying a seat, a backrest carrier carrying a backrest, a first lever parallelogram to hold the backrest upright both in the sitting position and in the standing position of the user, and means for moving the backrest to the trailing end of the seat during a change from the sitting position to the standing position, the first lever parallelogram having a first double-armed parallelogram lever. Stand-up units of this type are for example used in stand-up wheelchairs and therapy chairs.

2. State of the Art

Even the first designers of stand-up wheelchairs were confronted with the problem that a relative movement between the seat and backrest surfaces and the chair user's body can occur during standing-up. The resultant shear forces can lead to decubitus in the user of the chair. A relative movement between the chair and the user's body is produced when the axis of rotation of the seat does not correspond to the axis of rotation of the knee joint. In reality, the situation is somewhat more complex because the knee joint does not perform a pure rotational movement. On the contrary, in addition, a translatory movement also takes place. A relative movement also takes place between the user's back and the backrest when the axis of rotation of the backrest does not correspond to the axis of rotation of the knee joint.

In order to avoid the undesirable relative movements described hereinbefore, as early as in 1969 the inventor of one of the first stand-up wheelchairs had the idea of forming the seat and backrest by a large number of padded rolls (U.S. Pat. No. 3,589,769). However, these stand-up wheelchairs have not proven to be successful. Some 10 years later WO 79/00647 proposed lowering the footrest as the user of the chair stands up in order in this way to avoid an undesirable relative movement between the seat and the user's body. However, the lack of stability of the footrest, which is articulated to the stand-up mount roughly at the level of the user's knee and, somewhat further down, is connected in an articulated manner to the chassis by a connecting member, proved to be disadvantageous. In the stand-up wheelchair according to EP 0 815 822, this drawback is avoided in that the footrest has a shaft which is guided in the chassis. Many documents reveal that the stand-up wheelchairs described therein do not allow the user to stand fully upright. On the contrary, the user remains in a slightly oblique position in which he exerts forces on the seat and backrest. Many designs of known wheelchairs are dependent on forces of this type in order to avoid blockage at the dead centre or in the region close to the dead centre of the stand-up mechanism (U.S. Pat. No. 3,589,769, U.S. Pat. No. 4,623,194, DE 26 25 046, FR 2 529 456 and the corresponding EP 0 146 660, EP 0 815 822, EP 1 600 134).

As the patent literature also discloses, almost all the stand-up wheelchairs proposed in the last 30 years make use of the lowering of the footrest, although an undesirable relative movement between the seat and user of the chair is not always avoided (FR 2 529 456 and the corresponding EP 0 146 660, U.S. Pat. No. 4,623,194, EP 0 815 822 and EP 1 600 134). If, however, it is necessary to lower the footrest as the user stands up, this presupposes that the footrest must be arranged relatively high in the sitting position. The user of the wheelchair thus sits much higher in the wheelchair than a non-disabled person on a normal chair.

U.S. Pat. No. 4,054,319, U.S. Pat. No. 4,456,086 and U.S. Pat. No. 6,125,957 have already described stand-up wheelchairs in which the footrest is at the same height in the sitting and standing positions. However, in these examples, the footrest is also arranged relatively high on a chassis; in addition, undesirable relative movements are not in all cases avoided.

DE 26 25 046 describes a stand-up chair which can also serve as a therapy chair. The chair has a cam which can be adapted to the ideal stand-up movements of the patient. Together with a guide member and a limiting lever, this cam controls and limits the stand-up movement of the seat and backrest. The aim of this mechanism was to prevent almost all relative movements between the user's body and the surface of the chair. However, the described mechanism did not achieve this aim because the axis of rotation between the backrest and seat is arranged at a relatively great distance from the hip joint of the user of the chair. Furthermore, the use of cam discs has the drawback that they are subjected to a high degree of wear during operation. This stand-up chair and known stand-up wheelchairs have been found to have the further drawback that the seat surface presses the user of the chair forward as he stands up, the lower legs in the region of the knees being pressed with additional pressure against the knee holders which are necessary in most cases. This often causes an incorrect standing position. WO 03/026550 therefore proposes a mechanism to move the knee holders forward during the change from the sitting to the stand-up position. However, a mechanism of this type makes the stand-up chair more expensive.

EP 0 146 660 discloses a stand-up wheelchair having a chassis with a stand-up mount articulated thereto. The stand-up mount has a seat carrier with a backrest carrier. Furthermore, a first and a second lever parallelogram are provided. The first lever parallelogram holds the backrest carrier upright both in the sitting and in the standing position of the user. The second lever parallelogram is used to lower the footrest. For this purpose, the first lever parallelogram has a double-armed parallelogram lever which forms an arm part of the second lever parallelogram. As was previously mentioned, this stand-up wheelchair, like almost all the stand-up wheelchairs proposed in the last 30 years, makes use of the lowering of the footrest. This has the drawback that the wheelchair user sits much higher on a wheelchair of this type than a non-handicapped person on a usual chair. This has proven to be disadvantageous, for example, when sitting at a table where, on the one hand, there is the risk that the user's knees will knock the tabletop and, on the other hand, the user is sitting much too high for activities such as writing or eating.

The previously examined stand-up chairs provide an articulation at just two points. EP 1 716 834, on the other hand, describes an apparatus having a large number of members connected in an articulated manner. The members form an articulated system having an articulation at three points, i.e. not just an articulation in the region of the user's knee joints and in the region of his hip joints, but a further articulation also for his foot joints. A member, which at the level of the foot joints is articulated to a frame, is thus provided on each side of the apparatus. Springs and weights are provided in order to compensate for the user's weight (FIG. 4). Furthermore, it is proposed to pull the backrest upward via a cable pull by means of a cable pull which runs over two rolls and has a weight suspended therefrom. Another proposal suggests attaching weights to the members which are articulated to a frame at the level of the foot joints so as to be able to pivot forward and backward. The first-mentioned proposal, which provides a weight on a cable, is suitable only for stationary chairs, but not for movable stand-up-wheelchairs. The second-mentioned proposal, attaching weights to the members at the level of the foot joints, is undesirable for stand-up wheelchairs because this increases the overall weight thereof. The proposal of articulating the stand-up mount to pivotable members, instead of to a stationary support, also makes the system according to EP 1 716 834 furthermore unattractive for use in stand-up wheelchairs. In stand-up wheelchairs, the stand-up mount is generally articulated to a stationary support which can be part of the chassis.

It is an advantage of the present invention to provide a stand-up unit which is suitable for stand-up wheelchairs and therapy chairs and at least substantially avoids the drawbacks described at the outset. In particular, almost no relative movement between the upper legs of the chair user and the seat is to take place as the user stands up and sits down. As little relative movement as possible should also take place between the back of the chair user and the backrest. The stand-up unit should allow the user to stand upright and also offer him secure support. The height of the armrest should also be in a position which is pleasant for the user of the chair, both when he is sitting and when he is standing. Finally, the stand-up unit should be as light as possible.

According to the invention, in a stand-up unit according to the type mentioned at the outset, this is achieved in that the first lever parallelogram has a second double-armed parallelogram lever, in that the arms of the two double-armed parallelogram levers form a second lever parallelogram with two further levers, in that the common pivot point of the two lever parallelograms is connected in an articulated manner to a first point of the footrest via a lever and in that the common pivot point of the aforementioned further levers of the second parallelogram is connected in an articulated manner to a second point of the footrest.

The formation according to the invention of the stand-up unit prevents almost all relative movements between the user's body and the seat as the user stands up, since the seat is raised as the user stands up. The fact that the footrest does not have to be lowered during the change from the sitting position to the standing position is particularly advantageous on use of the stand-up unit in stand-up wheelchairs. In stand-up wheelchairs, the footrest can be arranged relatively low in the sitting position, so that the user of the chair does not sit much higher than a normal chair user; this is advantageous particularly when eating or working at a table. In contrast to the system of EP 1 716 834, in the described stand-up unit, the stand-up mount is articulated not to pivotable members, but to a stationary support, as is also the case in most stand-up wheelchairs. This has the advantage that further measures, such as for example weights on pivotable members of this type, are not necessary, and the overall weight of the stand-up unit can thus be kept low.

In therapy chairs, the footrest can extend flat in relation to the ground. The footrest can also be dispensed with. However, in this case, the support is expediently formed so as to be height-adjustable in order to permit adaptation to the user. The fact that the legs of the user of the chair are not pressed intensively against the knee holders as he stands up is also advantageous. The knee holder therefore does not require a mechanism in order to prevent this. A further advantage of the invention consists in the fact that the stand-up mount is suitable for use with various types of chassis.

Depending on the state of the user's health, the stand-up unit can be used with or without a linear drive. Expediently, the linear drive is arranged between the support and the first lever parallelogram. Expediently, the first lever parallelogram has a third double-armed parallelogram lever, on the arm of which the backrest carrier is displaceable. Furthermore, the first double-armed lever is connected in an articulated manner to the backrest carrier by means of a rod. The backrest carrier is therefore moved downward as the user stands up, so that no relative movement takes place between the backrest and the user's back.

A linear drive, which can be actuated by the user for standing up and sitting down, can be provided between the footrest and the first lever parallelogram. A motor drive is not required for users having minor disabilities. However, it is in any case expedient to provide spring means in order to counteract the user's body weight.

A particularly advantageous formation of the stand-up unit makes provision for the lever, which is connected in an articulated manner to the footrest, to have a first spring joint element, for example what is known as a ROSTA element, which is coupled to the first lever parallelogram lever and for the lever to have a second spring joint element which is coupled to the footrest. In the sitting position, the spring elements are biased and strive to pivot the seat upward counter to the user's weight. Advantageously, the spring joint elements generate, after reaching a predetermined pivot position, a force which counteracts the further upward pivoting of the seat. This has the advantage that the joint play is cancelled and stand-up wheelchair ensures secure support for the user in the standing position. In contrast to most known stand-up wheelchairs, the user can stand fully upright.

Advantageously, the stand-up mount has two seat frames between which the seat, backrest and footrest are arranged. This produces a particularly stable design.

BRIEF DESCRIPTION OF THE DRAWINGS

An exemplary embodiment of the invention will now be described with reference to the drawings, in which.

DETAILED DESCRIPTION OF THE ILLUSTRATED EMBODIMENTS

Figure 1:
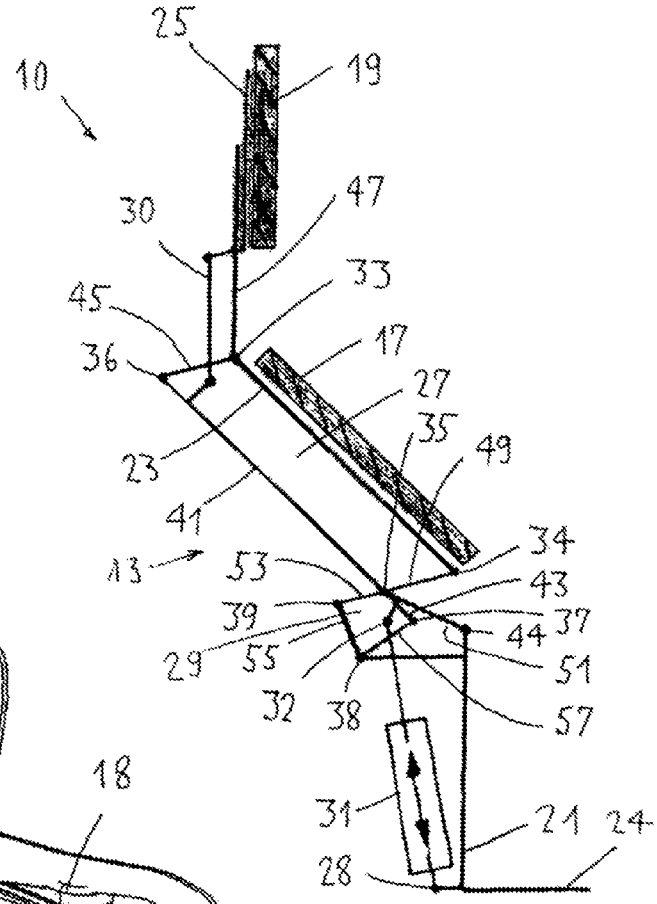
FIG. 1 is a schematic illustration of the stand-up unit.

The stand-up unit 10 illustrated in FIGS. 1 to 6 has a support 21 and a stand-up mount 13 articulated to the support.

In the exemplary embodiment shown, the stand-up mount 13 has two side frames 15 (FIG. 2, 9, 10) between which the seat 17, backrest 19 and footrest 24 are arranged. The side frames 15 have a large number of levers which are illustrated schematically in FIG. 1. It would however also be possible to centrally arrange a single lever system of this type.

Figure 2:
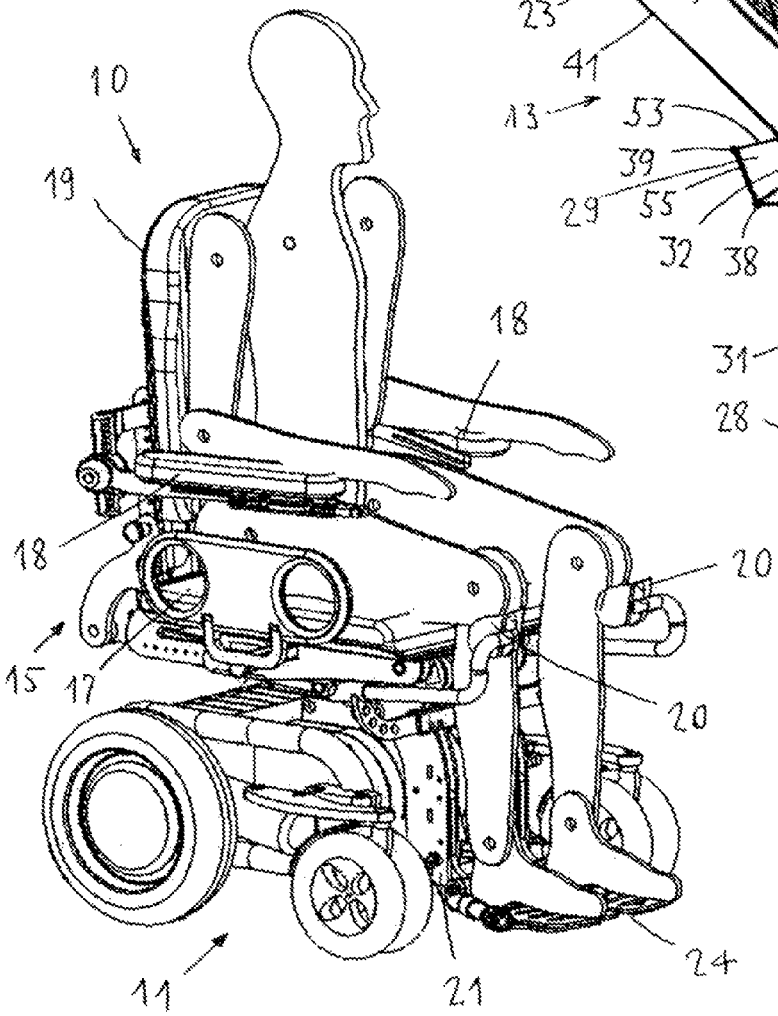
FIG. 2 is a perspective illustration of a stand-up wheelchair having a stand-up unit, viewed laterally from the front, together with the schematic illustration of a user of the chair, the joints of the user of the chair being visible.
Figure 3:
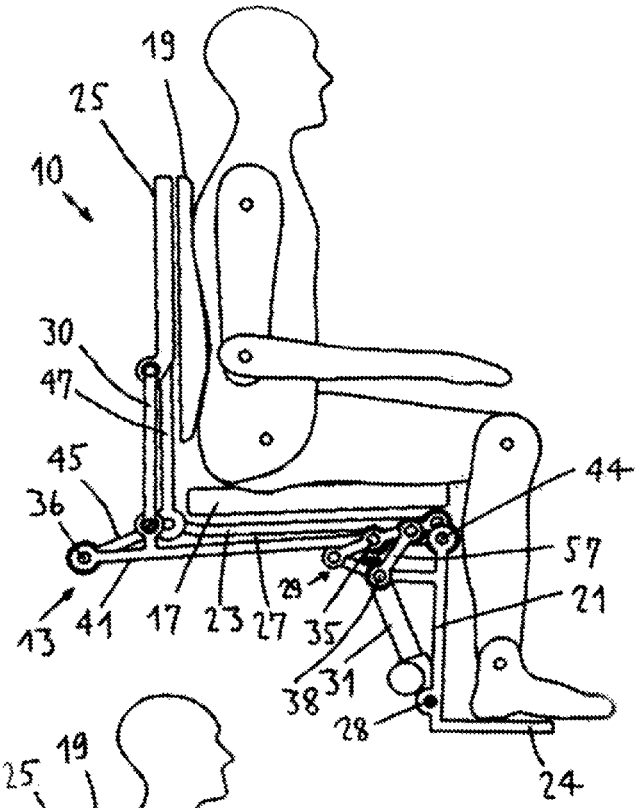
FIG. 3 shows the stand-up unit with the user of the chair in the sitting position.
Figure 4:
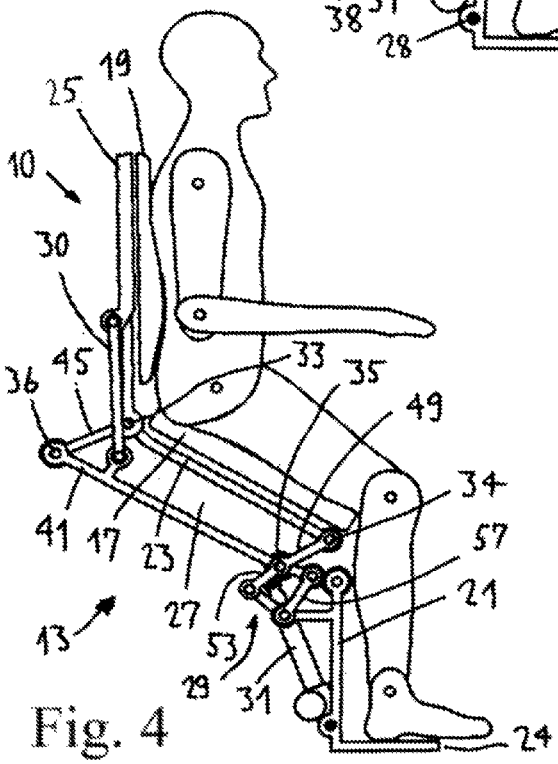
FIG. 4 shows the stand-up unit with the user of the chair as he stands up or sits down.
Figure 5:
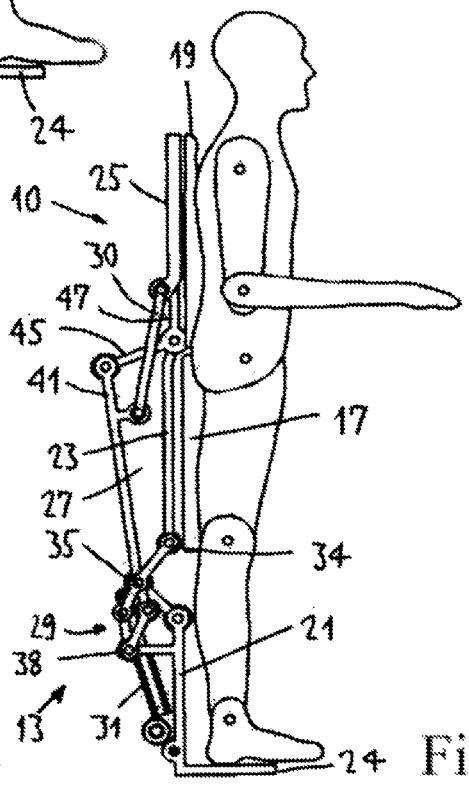
FIG. 5 shows the stand-up unit with the user of the chair in the standing position.
Figure 6:
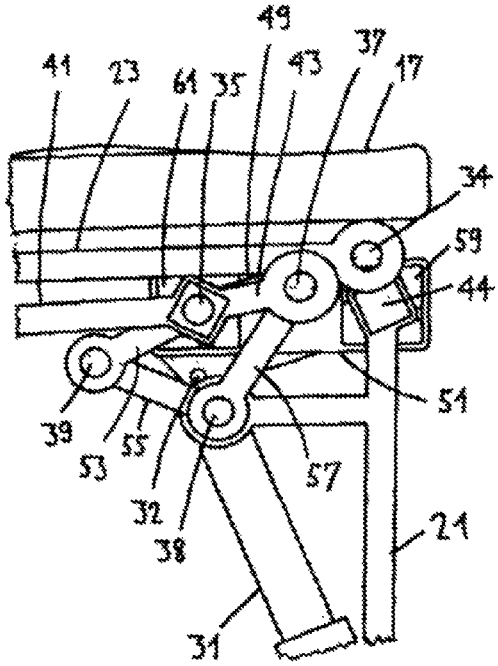
FIG. 6 shows an enlarged detail from FIG. 3.
Figure 7:
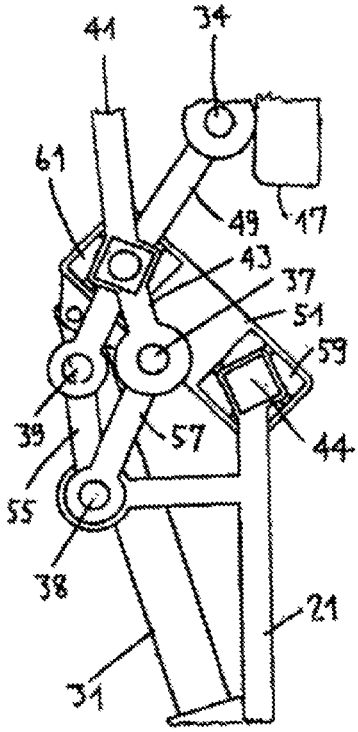
FIG. 7 shows an enlarged detail from FIG. 5.
Figure 9:
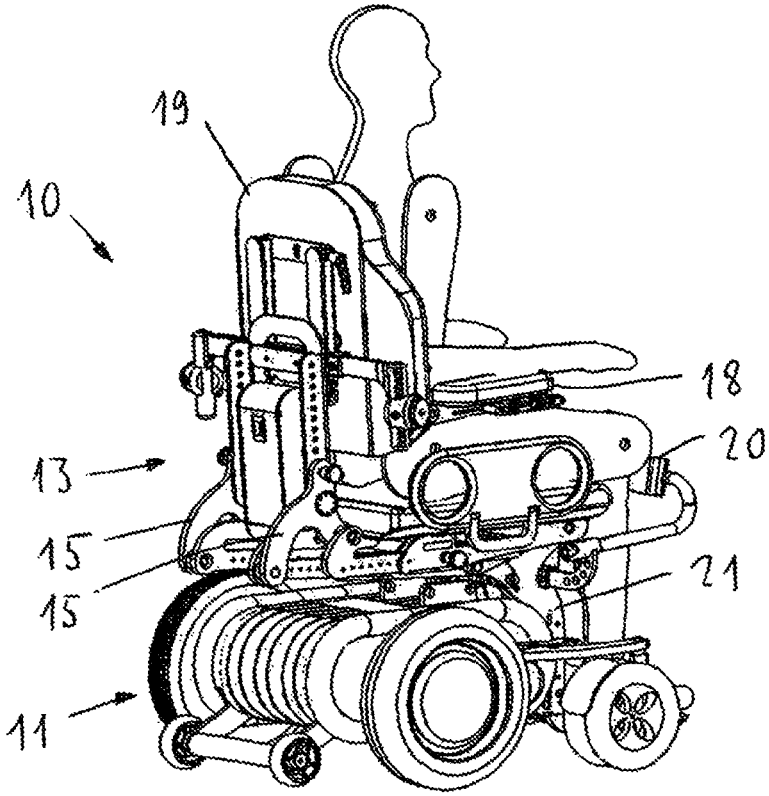
FIG. 9 is a view of the stand-up wheelchair as in FIG. 1, but viewed laterally from the rear.
Figure 10:
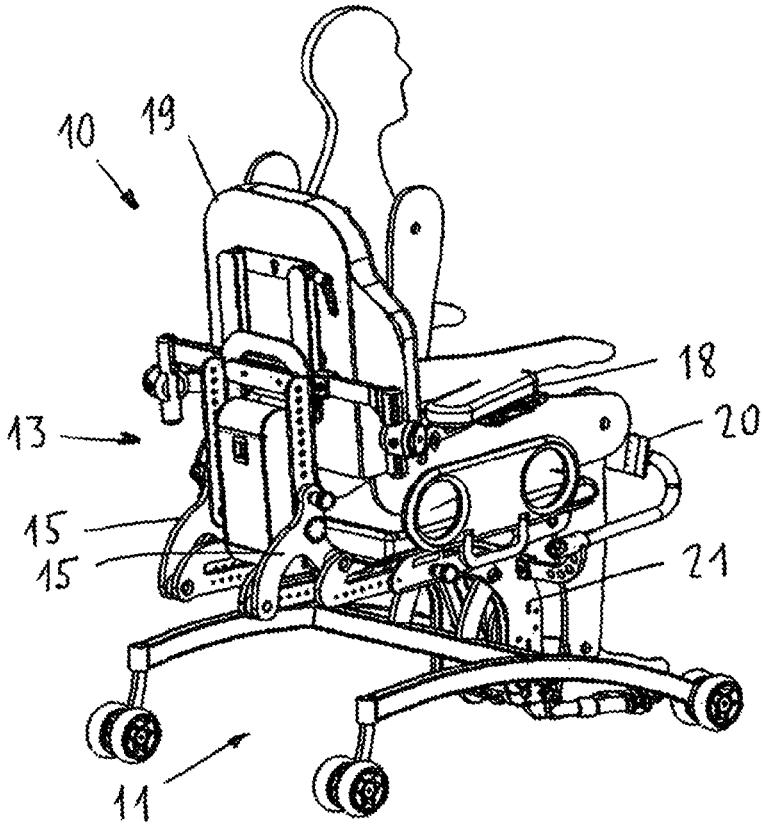
FIG. 10 shows a stand-up wheelchair with a different chassis.

FIGS. 2, 9 and 10, which show the use of the stand-up unit in stand-up wheelchairs, also show the armrests 18 fastened to the backrest carrier 25, as well as the knee holders 20.

The design of the stand-up unit 10 is most clearly apparent from the schematic illustration in FIG. 1 and FIGS. 3 to 7 which show the sequence of movement. The stand-up mount 13, which is arranged on the support 21, has a seat carrier 23 carrying the seat 17 and a backrest carrier 25 carrying the backrest 19. Furthermore, the stand-up mount 13 has a first lever parallelogram 27 and a second lever parallelogram 29. The first lever parallelogram 27 serves to hold the backrest 19 upright both in the sitting position and in the standing position of the user. The second lever parallelogram 29 serves to move the seat 17 upward in relation to the footrest 24, which is arranged on the support 21, during a change from the sitting position to the standing position. Furthermore, means 30 are present in order to move the back rest 19 toward the trailing end of the seat 17 during a change from the sitting position to the standing position. It will be clear to the person skilled in the art that the movement proceeds in the opposite direction during a change from the standing position to the sitting position. In order to carry out a change from the sitting position to the standing position or vice versa, a linear drive 31 is provided between the support 21 and the first lever parallelogram 27. The linear drive 31 is articulated at 28 to the support 21 and at 32 to the lever 51. A gas spring or another spring device, which compensates for the body weight of the user of the chair, can be provided in addition to the linear drive 31. Spring joint elements have proven to be particularly advantageous, as will be described hereinafter with reference to FIGS. 6 and 7. A linear drive 31 can be dispensed with if the chair user has sufficient muscular strength.

The first lever parallelogram 27 has the pivot points 33 to 36. The second lever parallelogram 29 has the pivot points 35, 37 to 39. The pivot point 35 is common to both lever parallelograms 27, 29. The first lever parallelogram 27 has four parallelogram levers 41, 49, 45, 23. Of these, three 41, 49, 45 are double-armed. The first (41) and the second (49) parallelogram levers have arms 43, 53 which form with two further levers 55, 57 the second lever parallelogram 29 which is articulated with the pivot point 38 to a point of the support 21. A lever 51 connects in an articulated manner the common pivot point 35 of the two lever parallelograms 27, 29 to the support 21 at 44.

The third parallelogram lever, 45, which is located at the rear part of the seat 17, has an arm 47 on which the backrest carrier 25 is displaceably arranged. Means, for example in the form of a rod 30 connecting the first parallelogram lever 41 to the backrest carrier 25 in an articulated manner, are used for displacing the backrest carrier 25.

FIGS. 3 to 5 and 6 and 7 show the sequence of movement during the change from the sitting position to the standing position and vice versa. It may be seen that almost no relative movements between the body of the chair user and the surfaces of the chair take place during these movement sequences. Thus, the front edge of the chair 17 moves upward and the backrest 19 moves downward during the change from the sitting position to the standing position.

It has already been stated that it is expedient to compensate for the body weight of the user of the chair by a spring device. This can be carried out for example, as disclosed in EP 0 815 822, by a gas spring. However, the use illustrated in FIGS. 6 and 7 of two spring joint elements 59, 61, for example of the ROSTA type, which are integrated in the lever 51, has proven to be particularly advantageous. The spring joint element 59 connects the lever 51 to the support 21 and the spring joint element 61 connects the lever 51 to the first parallelogram lever 41. In the sitting position (FIG. 6), both spring joint elements 59, 61 are biased and strive to pivot the seat 17 upward until the seat reaches a pivot position of approximately 55 degrees. Away from this position, the further pivoting takes place into the end position of FIG. 7, counter to the force of the spring elements 59, 61.

In the end position (FIGS. 5 and 7), the seat 17 and backrest 19 are in the perpendicular position and allow the user in contrast to most known stand-up wheelchairs—to stand fully upright. In this position, there is no risk of the stand-up mechanism becoming blocked on account of the dead centre, since the dead centre is not yet reached in this position and because, as has just been mentioned, the last part of the stand-up movement was carried out counter to a spring force, the energy stored as a result in the spring joint elements 59, 61 helps the seat 17 to pivot back into the sitting position. A further advantage of the spring joint elements 59, 61 consists in the fact that they cancel the joint play and the seat 17 and backrest 19 therefore offer the user secure support in the fully upright standing position.

Figure 8:
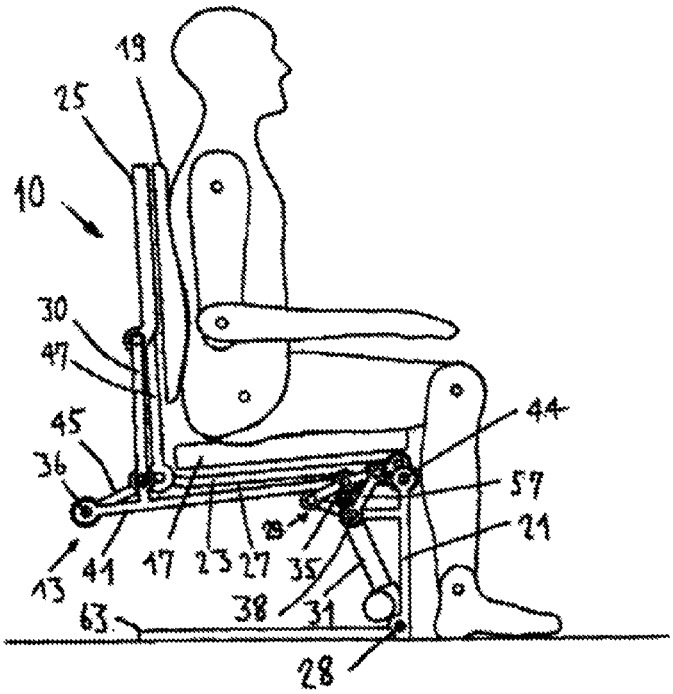
FIG. 8 shows a chair with a stand-up unit.

FIGS. 8 to 10 show a chair and two different stand-up wheelchairs with a stand-up unit 10. In the chair from FIG. 8, the stand-up unit 10 is fastened to a pedestal 63. A foot rest has been dispensed with in this exemplary embodiment. For the use of the chair as a therapy chair, the support 21 could be configured so as to be height-adjustable, as has for example already been proposed in DE 26 25 046.

FIGS. 9 and 10 show by way of example that various chassis 11 can be used.

Various alterations are possible without departing from the inventive concept. Thus, it is also possible to use other spring means, instead of ROSTA elements, for the same purpose.

In summary, the following may be stated:

The stand-up unit 10 has a support 21 and a stand-up mount 13 which is articulated to the support 21 and has a seat carrier 23 carrying a seat 17 and a backrest carrier 25 carrying a backrest 19. A first lever parallelogram 27 is also provided to hold the backrest 19 upright in any position. The backrest 19 can be displaced by the first lever parallelogram 27 by means of a rod 30 in order to prevent any undesirable relative movement between the backrest 19 and the user's back as he stands up or sits down. A second lever parallelogram 29 controls the movement of the seat 17 as the user stands up and sits down, thus preventing any relative movement between the seat 17 and the user's buttocks. When provided with a pedestal, the stand-up unit can serve as a chair, in particular as a therapy chair. However, when connected to a chassis, the stand-up unit can also serve as a stand-up wheelchair.

What is claimed is:

1. A stand-up unit, comprising:

(a) a first parallelogram comprising first, second, third, and fourth levers operably coupled to each other at first parallelogram pivot points, wherein the first lever comprises a first arm and the second lever comprises a second arm;

(b) a second parallelogram comprising fifth and sixth levers and the first and second arms operably coupled to each other at second parallelogram pivot points, wherein one of the first parallelogram pivot points and one of the second parallelogram pivot points is a single common pivot point;

(c) a support comprising a first support lever operably coupled to the common pivot point and a second support lever operably coupled to the second parallelogram;

(d) a rod operably coupled at a first end to the first lever and at a second end to a backrest carrier;

(e) a backrest operably coupled to the backrest carrier; and (f) a seat operably coupled to the third lever.

2. The stand-up unit of claim 1, wherein the first parallelogram is configured to hold the backrest upright both in a sitting position and in a standing position of a user.

3. The stand-up unit of claim 1, further comprising a footrest operably coupled to the support.

4. The stand-up unit of claim 3, wherein the second parallelogram is configured to move the seat upward in relation to the footrest.

5. The stand-up unit of claim 1, wherein the rod is configured to move the backrest toward a trailing end of the seat during a change from a sitting position to a standing position.

6. The stand-up unit of claim 1, further comprising a linear drive operably coupled to the support and the first parallelogram.

7. The stand-up unit of claim 1, further comprising a first spring joint element operably coupled to the first support lever and the support and a second spring joint element operably coupled to the first support lever and the first lever.

8. The stand-up unit of claim 7, wherein, in the sitting position, the first and second spring joint elements are biased and strive to pivot the seat upward.

9. The stand-up unit of claim 8, wherein the first and second spring elements generate, after reaching a predetermined pivot position, a force that counteracts further upward pivoting of the seat.

10. The stand-up unit of claim 1, further comprising a chair to which the stand-up unit is operably coupled and further including a pedestal.

11. The stand-up unit of claim 10, wherein the support is height-adjustable.

12. The stand-up unit of claim 1, further comprising a wheelchair with a chassis to which the stand-up unit is operably coupled.

13. The stand-up unit of claim 12, further comprising a footrest operably coupled to the support.

14. A stand-up unit, comprising:

(a) a support comprising a first support lever and a second support lever;

(b) a footrest operably coupled to the support; and (b) a stand-up mount operably coupled to the support, the stand-up mount comprising:

(i) a first parallelogram comprising first, second, third, and fourth levers operably coupled to each other at first parallelogram pivot points, wherein the first lever comprises a first arm and the second lever comprises a second arm;

(ii) a second parallelogram operably coupled to the second support lever, the second parallelogram comprising fifth and sixth levers and the first and second arms operably coupled to each other at second parallelogram pivot points, wherein one of the first parallelogram pivot points and one of the second parallelogram pivot points is a single common pivot point, wherein the common pivot point is operably coupled to the first support lever;

(iii) a rod operably coupled at a first end to the first lever and at a second end to a backrest carrier;

(iv) a backrest operably coupled to the backrest carrier; and (v) a seat operably coupled to the third lever.

15. The stand-up unit of claim 14, wherein the first parallelogram is configured to hold the backrest upright both in a sitting position and in a standing position of a user.

16. The stand-up unit of claim 14, wherein the second parallelogram is configured to move the seat upward in relation to the footrest.

17. The stand-up unit of claim 14, wherein the rod is configured to move the backrest toward a trailing end of the seat during a change from a sitting position to a standing position.

18. The stand-up unit of claim 14, further comprising a chair to which the stand-up unit is coupled and further including a pedestal.

19. The stand-up unit of claim 14, further comprising a wheelchair with a chassis to which the stand-up unit is coupled.

20. The stand-up unit of claim 14, wherein the stand-up mount further comprises two seat frames disposed between the seat and the backrest.

* * * * *